United States Patent [19]

Locke

[11] Patent Number: 4,991,532

[45] Date of Patent: Feb. 12, 1991

[54] AUTOMATIC CONTROL OF ENGINE COMPARTMENT VENTILATION

[75] Inventor: Richard A. Locke, Milwaukie, Oreg.

[73] Assignee: Boat Safe Products, Inc., Portland, Oreg.

[21] Appl. No.: 360,390

[22] Filed: Jun. 2, 1989

[51] Int. Cl.[5] ..... B63J 2/00

[52] U.S. Cl. ..... 114/211; 98/1; 440/88

[58] Field of Search ..... 114/211; 98/1; 307/9.1, 307/10.6; 429/71; 60/272, 315, 685, 686, 694, 695; 440/84, 85, 87, 88; 340/632; 417/1, 14, 44

[56] References Cited

U.S. PATENT DOCUMENTS

| | | | |
|---|---|---|---|
| 1,285,659 | 11/1918 | Ford | 114/211 |
| 3,315,584 | 4/1967 | Van Ranst | 98/1 |
| 3,489,912 | 1/1970 | Hoffman, Jr. | 307/9 |
| 3,695,208 | 10/1972 | Fixler | 114/211 |
| 3,789,231 | 1/1974 | Hayden | 307/9 |
| 3,948,202 | 4/1976 | Yoshikawa | 114/211 |
| 3,951,091 | 4/1976 | Doench | 114/211 |
| 4,037,578 | 3/1977 | Dersch | 114/211 |
| 4,134,112 | 1/1979 | Kercheval et al. | 340/632 |
| 4,235,181 | 11/1980 | Stickney | 114/211 |

FOREIGN PATENT DOCUMENTS

| | | |
|---|---|---|
| 1903849 | 9/1980 | Fed. Rep. of Germany . |
| 38109 | 3/1984 | Japan . |
| 57012 | 4/1984 | Japan . |

*Primary Examiner*—Joseph F. Peters, Jr.
*Assistant Examiner*—Clifford T. Bartz
*Attorney, Agent, or Firm*—Chernoff, Vilhauer, McClung & Stenzel

[57] ABSTRACT

An automatic fan controller for energizing a ventilation fan motor to eliminate fuel fumes from an engine compartment of a motorboat. A relay which provides electrical power to the motor of the ventilating fan when energized is controlled by an electronic circuit responsive to engine ignition circuit pulses, to keep the fan operating whenever engine speed is below a desired value. Additionally, a temperautre-controlled switch may be provided to energize the relay providing power to the fan motor until engine temperature reaches a certain level. A timer is provided in the electronic circuitry to prevent momentary activation of the ventiliation fan should the engine speed be varying slightly about the minimum engine speed.

9 Claims, 2 Drawing Sheets

AUTOMATIC CONTROL OF ENGINE COMPARTMENT VENTILATION

BACKGROUND OF THE INVENTION

The present invention relates to motorboats with inboard engines, and more particularly to a safety device for automatically operating a ventilation fan for an engine compartment until the boat has reached a speed at which natural ventilation of the engine compartment is sufficient for safety against combustible mixtures of fuel fumes and air.

Fires in the engine compartments and bilge areas of motorboats powered by gasoline engines annually cause thousands of documented boat fires. It is suspected that the number of documented fires from such causes represents only a small minority of the actual occurrences.

Most of the fires in engine compartments result from ignition of accumulated fuel fumes. The fumes from even a small amount of fuel leakage into the bilges and engine compartment of a motorboat can result in a highly explosive mixture which is heavier than clean air and therefore remains in the bilge areas and is likely to remain in the engine compartment of a motorboat while it rests alongside a pier. Any spark, such as a spark which may occur within a starter motor, may be sufficient to ignite the explosive gas mixture, with disastrous results.

In order to avoid fires started in fuel fumes it is commonly accepted procedure to start a ventilation fan in operation prior to first starting the engine of such a boat. However, should there be an active leak of fuel from a carburetor, a fuel line, or other source, fumes may continue to accumulate during operation of the engine, so long as the boat lies at rest or its motion through the water does not result in sufficient flow of ambient air to flush fumes from the engine compartment and other low-lying areas within the hull of the boat. Fortunately, so long as the boat is moving through the water at an ample speed, fumes are less likely to accumulate undiscovered as an explosive mixture in dangerous quantities in locations where sparks are likely to be present. So long as a properly designed motorboat travels forward at an adequate speed, there exists a natural convection flow of air through the engine compartment to remove hazardous vapors.

What is not provided for by the prior art, however, are the many situations where there is no forward movement of the boat, yet the engine is running and the engine compartment ventilation system has been turned off. In such situations, the operator of a motorboat is likely not to turn on the ventilation fan, and combustible vapors can then accumulate in quantities sufficient to create explosive or flammable mixtures of fumes with the air.

In the past, various attempts have been made to avoid the risk of explosion and fire in motorboats with inboard engines. Devices have been disclosed, as in Yoshikawa U.S. Pat. No. 3,948,202 and Haden U.S. Pat. No. 3,789,231 for turning on an exhaust fan in a boat in response to sensing that vapors exceed a predetermined concentration in a particular enclosed area of a boat. Other devices have provided for delay in activation of starting and ignition circuits of motorboat engines until ventilating fans have been operated for a time, as disclosed in Doench U.S. Pat. No. 3,951,091.

Van Ranst U.S. Pat. No. 3,315,584, Kercheval, et al. U.S. Pat. No. 4,134,112, and Hoffman, Jr. U.S. Pat. No. 3,489,912 disclose devices which include vapor detectors used together with devices which control operation of the starter or engine of a motorboat at least partially in response to sensing the presence of flammable or explosive gas.

While such prior art devices may be helpful in preventing fires, they depend upon detection of a condition which may already be dangerous, rather than providing a way to prevent accumulation of dangerous fumes in the engine compartment of a boat.

Japanese patent No. 59-38109 discloses control of ventilation fans for the passenger compartment of an automobile, in response to stoppage or slow movement, but the invention appears to be related to ventilation for comfort, rather than having any relationship to safety from ignition of fuel fumes.

What is needed, then, is a method and apparatus for preventing accumulation of dangerous fumes at all times during operation of an inboard engine of a motorboat, rather than only prior to initial start-up of the engine.

SUMMARY OF THE INVENTION

The present invention overcomes the aforementioned shortcomings of the prior art by providing a method and apparatus for preventing accumulation of dangerously flammable or explosive fumes in the engine compartment and related spaces in a motorboat. In accordance with the present invention, a ventilation fan is activated automatically upon starting of an inboard engine, and is kept operating until the engine speed has been increased sufficiently for the resulting motion of the motorboat to provide ample ventilating flow of fresh air through the engine compartment. Additionally, the fan is reactivated at any time when the engine speed drops below that which is required to propel the boat fast enough to maintain such a ventilating flow of air ample to keep dangerous fumes purged from the engine compartment.

In a device which is a preferred embodiment of the invention, the electric motor of a ventilating fan is provided with electricity controlled by a relay operated in response to engine rpm. So long as engine rpm remains below a predetermined value the device provides a path for electric power to the ventilating fan. Only after engine speed has increased above the minimum value does the device, in response to engine speed, permit the relay to be opened to deactivate the ventilating fan. The device of the invention is installed in an electric circuit in parallel with other power supply controls, so that the usual manually controllable power switch for operation of the ventilating fan can still be used to keep the fan in operation. As a result, ventilation can be continuous if desired by the operator of a motorboat equipped with a device embodying the present invention.

In a preferred embodiment of the invention, an additional switch, responsive to the temperature of the engine, is connected to provide for activation of the relay of the device. This keeps the ventilating fan in operation until the boat's engine has operated long enough to raise its temperature to a level which assures that ample opportunity has been provided for effective ventilation of the engine compartment of the motorboat. Thus, even if the engine is operated with the propellor shaft disengaged, or during maneuvering without gaining appreciable headway, the ventilation fan will be operated during the warming-up of the engine, even if engine speed goes higher than the minimum at which the device would otherwise open the relay.

Accordingly, it is a principal object of the present invention to provide a method for assuring ventilation of an engine compartment of a motorboat.

It is another principal object of the present invention to provide a device for controlling an electric ventilation fan so as to assure ventilation of an engine compartment at times when a motorboat may not be proceeding fast enough for natural ventilation of an engine compartment to prevent accumulation of flammable and explosive fumes.

It is an important feature of the present invention that it utilizes a measurement of engine speed, rather than measurement of accumulation of explosive fumes, as the criterion for determining whether to energize a ventilation fan.

It is another important feature of the present invention that it provides a device for automatically continuing operation of a ventilating fan to ventilate an engine compartment of a motorboat during the engine's initial operation and warm-up to normal operating temperature.

An important advantage of the present invention is that it provides for greater safety by assuring ventilation of an engine compartment to prevent accumulation of dangerously flammable or explosive fumes, rather than simply providing an indication that such fumes have already begun to accumulate.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
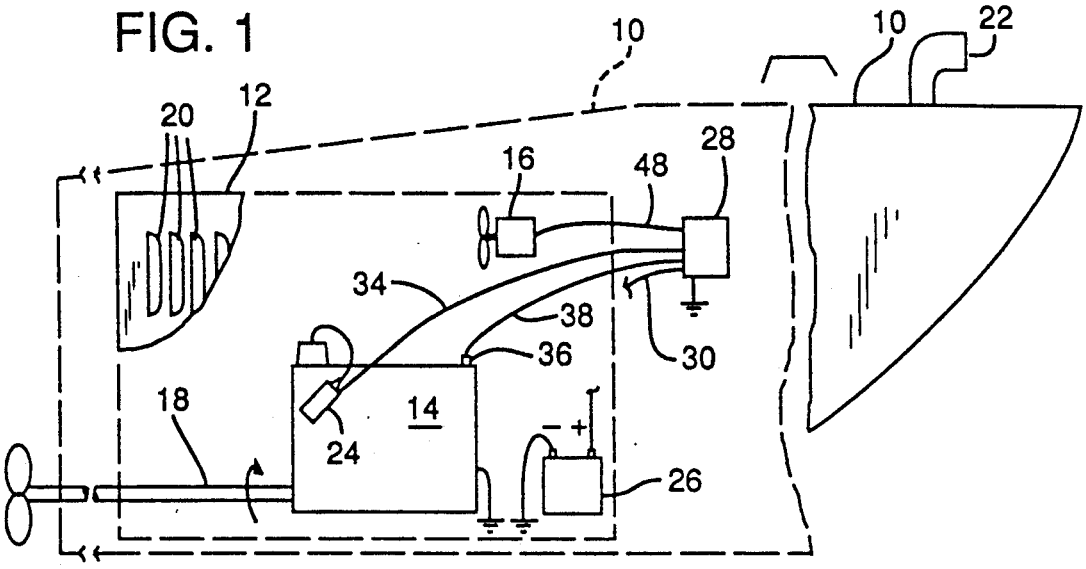
FIG. 1 is a schematic side view of a motorboat equipped with an inboard engine and the engine compartment fan controller of the present invention.

Referring now to FIG. 1 of the drawings, a motorboat 10 includes an engine compartment 12, shown diagrammatically in broken line, and an internal combustion engine 14, located within the engine compartment 12. An electric ventilating fan 16 is shown as being located within the engine compartment 12, although it might be located separately and connected by appropriate ducting to provide a ventilating flow of air through the engine compartment 12. The boat 10 is propelled by a propeller rotated by a shaft 18 driven by the engine 14.

Ordinarily, when the motorboat 10 is moving forward, the relative wind causes natural circulation of air sufficient to ventilate the engine compartment 12. When the boat 10 is moving through the water, an adequate flow of fresh air may be provided through ventilation openings such as louvers 20 located on the engine compartment and an appropriately located ventilation intake duct 22.

The engine 14 is, for example, a gasoline engine equipped with an ignition coil 24 and an associated electrical system including a battery 26.

Figure 2:
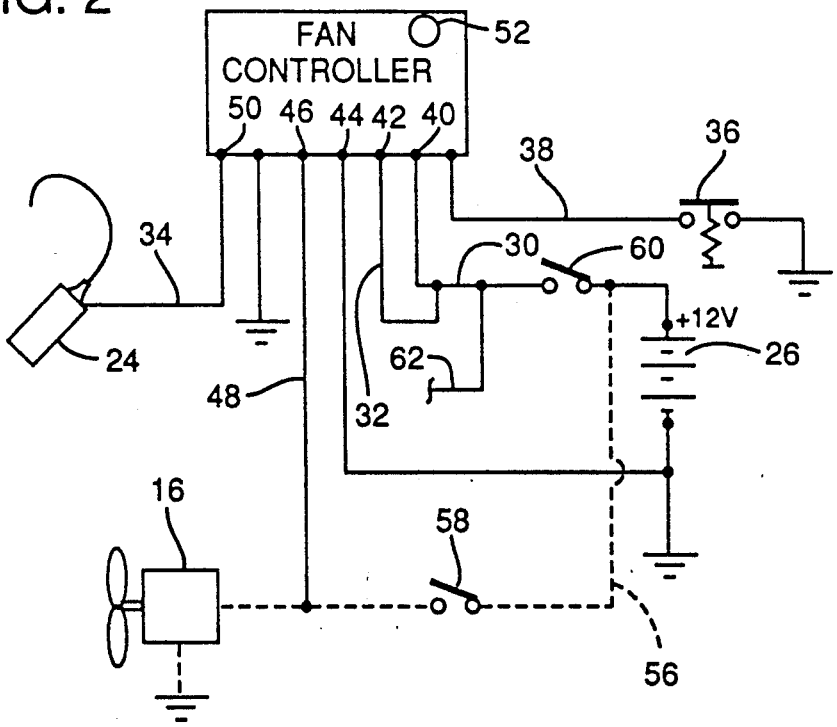
FIG. 2 is an electrical circuit diagram illustrating the electrical connection of the fan controller of the invention.

An automatic ventilation fan controller 28 may be located within the engine compartment 12, but is preferably located in a position where it is visible to the operator of the boat 10. The fan controller 28 may be provided in the form of a small encapsulated package provided with terminals for accomplishing required electrical connections such as those to the engine 14, the battery 26, and the fan 16. A conductor 30 is electrically connected to the fan controller 28 to power the fan controller. An electrical conductor 32 is also connected to the controller 28 as a path for electrical power from the battery 26 to the fan 16 at appropriate times as is shown in FIG. 2. A conductor 34 electrically connects the distributor side of the primary winding of the ignition coil 24 of the engine 14 with the fan controller 28. An optionally provided temperature-controlled switch 36 is mounted on the engine 14, and a conductor 38 connects the temperaturecontrolled switch 36 with the fan controller 28. An indicator, such as a light emitting diode 52, shown in FIG. 2, is preferably provided on the fan controller 28.

A preferred embodiment of the fan controller 28 is supplied with a positive 12 volt direct current supply from the battery 26 by the conductor 30, through a terminal 40. Additionally, the 12 volt positive electrical potential is provided to a separate terminal 42, as the source of electrical power to be controlled by the fan controller 28. A terminal 44 provides for connection of the electrical components of the fan controller 28 to electrical ground. A terminal 46 and a conductor 48 provide a path for power to the motor of the electric fan 16 controlled by the fan controller 28. A terminal 50 provides for connection of the conductor 34 to the fan controller 28 to receive impulses from the low voltage terminal of the coil 24 which forms a part of the ignition system of the engine 14. Such impulses are created in the ignition system of the engine 14 at a frequency in direct relationship to the speed of the engine 14, and are utilized in the circuitry of the fan controller 28 to determine the speed of rotation of the engine 14 during its operation. (In the case of a diesel engine, since there is no electric ignition system a device would have to be added to the engine to provide such impulses.)

A conductor 56, shown in broken line, interconnects the positive terminal of the battery 26 with the electric motor of the electric fan 16, through a fan control switch 58. The conductors 30 and 32 are connected to the battery 26 through an ignition control switch 60, which also provides power for the ignition system of the engine 14 through an ignition conductor 62.

Figure 3:
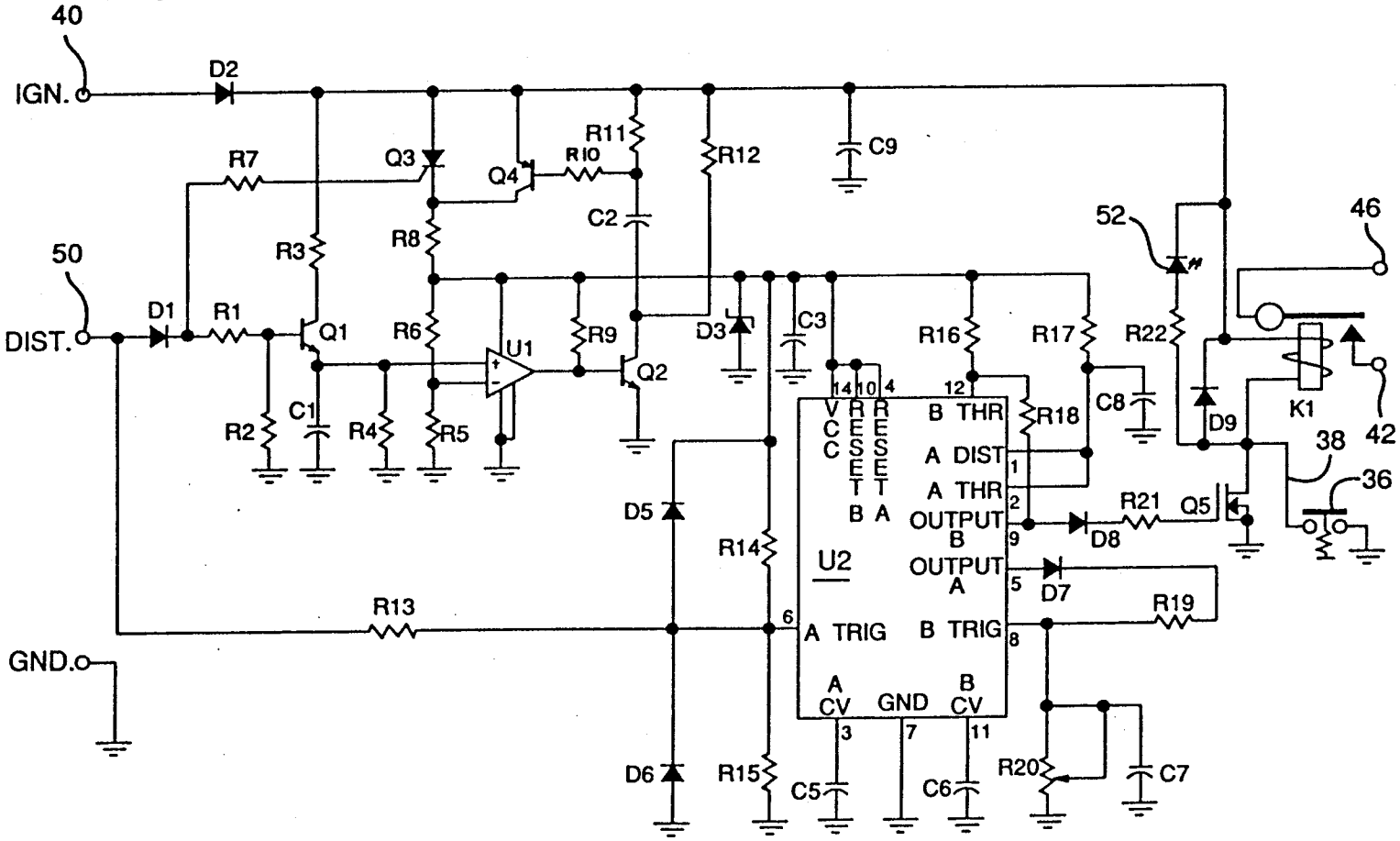
FIG. 3 is a schematic diagram of a circuit for a fan controller which is a preferred embodiment of the invention.

Referring now to FIG. 3, a circuit is shown which is a preferred embodiment of the fan controller 28. Values, and acceptable part number designations for the electronic components of the circuit shown in FIG. 3 are listed below in Table I. The value of capacitor C1, as shown in Table I, is for an eight cylinder engine. For a six cylinder engine the value of C1 should be 1.5 μf, and for a four cylinder engine, the value of C1 should be 1.0 μf.

TABLE I

| Circuit Element Designation | Value or Part Number |
|---|---|
| C1 | 2.2 μf |
| C2 | 0.1 μf |
| C3 | 10. μf Tant. |

TABLE I-continued

| Circuit Element Designation | Value or Part Number |
|---|---|
| C5 | 0.01 μf |
| C6 | 0.01 μf |
| C7 | 1. μf |
| C8 | .01 μf |
| C9 | 330. μf Alum. |
| D1 | 1N 4148 |

The fan controller circuit includes a relay K1 which acts as a fan power switch to conduct current to power the fan from terminal 42 to terminal 46 when the ignition switch 60 has been closed to provide a nominal 12 volts at terminals 40 and 42, until the engine rpm, as evaluated by the fan controller 28, has reached a predetermined value. In the preferred embodiment shown, the relay K1 is also kept energized until the thermostatically controlled switch 36 has opened as a result of the engine temperature having increased to a certain value. For a conventional motorboat equipped with a gasoline engine, an engine speed of 1550 rpm will normally result in adequate boat speed and relative wind to ensure sufficient ventilating flow of air through the engine compartment 12 to continue to keep a mixture of fuel fumes and air from reaching a flammable or explosive concentration. In order to assure that the ventilation fan 16 operates initially for a period long enough to clear accumulated fumes from the engine compartment 12 during warm up of the engine, it is desirable to keep the thermostatically controlled switch 36 closed until the engine coolant fluid reaches a temperature of at least about 120° F. (49° C.).

Supply voltage provided through terminal 40 is conducted through diode D2 to relay K1, and, so long as temperature controlled switch 36 remains closed a current path is provided to ground, energizing relay K1 and conducting electrical power from terminal 42 to terminal 46 of the fan controller 28 and delivering it via conductor 48 to the motor of the fan 16.

Should the temperature-controlled switch 36 be inoperative or not be provided (since it is an optional feature of the fan controller 28), relay K1 is, nevertheless, maintained in an energized state by conduction through field effect transistor Q5 to ground, so long as transistor Q5 is kept in a conducting state by the action of integrated circuit U2. Integrated circuit U2 maintains conduction through Q5 to ground to maintain the relay K1 in an energized state, so long as the engine rpm remains below the required value, as determined by sensing electrical impulses in the coil 24.

Primary voltage pulses in the coil 24 are delivered to terminal 50 of the fan controller 28 and are conducted to the base of transistor Q1 to control current through transistor Q1 to charge capacitor C1, which is also being bled to ground by resistor R4. Operational amplifier U1 compares the voltage in capacitor C1 with the voltage across resistance R5. When the engine rpm is great enough, indicating that the engine speed has increased to the desired minimum at which the boat 10 will be proceeding fast enough to assure natural ventilation of the engine compartment 12, transistor Q1 is conductive enough of the time to charge capacitor C1 to a voltage great enough for the output of, operational amplifier U1 to be low, and transistor Q2 is turned off.

The junction of zener diode D3 and resistor R8 provides the main power bus for the remainder of the circuit. Capacitor C3, in parallel with zener diode D3 suppresses noise and provides a current reserve for driving transistor Q2.

So long as power is provided through terminal 40, the inverting pin of the comparator U1 monitors the voltage of capacitor C1, which is bled by resistor R4. The pulses of current from the primary windings of the ignition coil 24 simultaneously gate the comparator U1 forward and turns on transistor Q1, which charges capacitor C1 through resistor R3. As long as the voltage in capacitor C1 is above that at the junction of the voltage divider formed by resistors R5 and R6, the output of the comparator remains low. When the engine is shut off by killing current to the ignition coil 24, or when engine rpm drops below the desired minimum, voltage in capacitor C1 begins to drop, as resistor R4 bleeds capacitor C1 faster than transistor Q1 can conduct to charge it.

After approximately four seconds, provided to avoid ineffectively short periods of activation of fan 16, capacitor voltage drops below the reference voltage across R5 and the output of the comparator U1 goes high, turning on transistor Q2, which momentarily turns off transistor Q4 and then interrupts current through the silicon controlled rectifier Q3. The voltages provided at the integrated circuit U2 cause the output B, at pin 9 of integrated circuit U2 to turn off FET Q5, opening the relay K1, so that power is no longer available through the fan controller 28 and conductor 48 to drive the motor of the ventilation fan 16.

Whenever the relay K1 is energized power is also provided to energize the LED 52 as an indication that power is being supplied to the ventilating fan 16 by the fan controller 28.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An automatic fan controller for an engine compartment of a boat having an electrical power supply, an inboard internal combustion engine, and an electrically powered ventilation fan arranged to ventilate said engine compartment, the fan controller comprising:

(a) engine speed sensor means for determining whether said engine is operating above a predetermined engine speed;

(b) electrically controlled power switch means for selectively connecting said power supply operatively to said ventilation fan;

(c) switch controller means responsive to said engine speed sensor means, for energizing said power switch means so as to connect said power supply operatively to said ventilation fan when said engine speed sensor means has determined that said engine is not operating above said predetermined engine speed; and (d) temperature sensitive means for energizing said power switch means in response to the temperature of said engine, so as to keep said power switch means closed to connect said electrical power supply to said ventilation fan so long as the temperature of said engine remains below a predetermined minimum temperature.

2. The fan controller of claim 1 wherein said predetermined engine speed is sufficient to assure natural ventilation of said engine compartment.

3. The fan controller of claim 1 wherein said engine speed sensor means includes means for detecting electrical impulses in an ignition system and utilizing the frequency of said impulses to determine whether said engine is operating above said predetermined engine speed.

4. The fan controller of claim 1, including indicator means for indicating that said fan controller is providing electrical power from said electrical power supply to said ventilation fan.

5. In a boat having an inboard internal combustion engine located in an engine compartment, the improvement comprising:

(a) an electrically driven ventilation fan arranged to ventilate said engine compartment;

(b) an electrical power supply;

(c) an engine switch connected electrically to said engine and said electrical power supply to selectively interconnect said electrical power supply with said engine;

(d) means for producing an electrical signal indicative of the speed of said engine during operation of said engine (e) automatic fan power switch means connected electrically to said ventilation fan and said electrical power supply for selectively providing electrical interconnection of said power supply to said ventilation fan;

(f) switch controller means connected electrically to said engine switch and said fan power switch means and responsive to said electrical signal, for operating said fan power switch means to energize said ventilation fan when said engine switch is providing electrical power to said engine, in response to said electrical signal indicating that said engine speed is below a predetermined minimum engine speed; and (g) temperature sensitive means for operating said fan power switch means in response to the temperature of said engine, so as to keep said fan power switch means closed to connect said electrical power supply to said ventilation fan so long as the temperature of said engine remains below a predetermined minimum temperature when said engine switch is providing electrical power to said engine.

6. The apparatus of claim 5, including indicator means for indicating that said fan controller is providing electrical power from said electrical power supply to said ventilation fan.

7. The apparatus of claim 6 wherein said predetermined minimum engine speed is sufficient to assure natural ventilation of said engine compartment.

8. The apparatus of claim 6 wherein said engine speed sensor means includes means for detecting electrical impulses in an ignition system and utilizing the frequency of said impulses to determine whether said engine is operating above said predetermined minimum speed.

9. A method for controlling operation of a ventilation fan in a boat equipped with an electrical power supply and an inboard engine located in an engine compartment, the method comprising (a) measuring the rotational speed of said engine (b) automatically connecting said electrical power supply to provide power to said ventilation fan for operation thereof in response to measuring said speed of rotation of said engine as being below a predetermined minimum speed;

(c) measuring the temperature of said engine; and (d) automatically connecting said electrical power supply to provide power to said ventilation fan for operation thereof in response to measuring said engine temperature as being below a predetermined minimum temperature.

* * * * *

UNITED STATES PATENT AND TRADEMARK OFFICE
CERTIFICATE OF CORRECTION

PATENT NO. : 4,991,532

DATED : February 12, 1991

INVENTOR(S) : Richard A. Locke

It is certified that error appears in the above-identified patent and that said Letters Patent is hereby corrected as shown below:

In the Abstract: Line 8 — Change "temperautre" to --temperature--.

Col. 4, Line 21 — Change "temperaturecontrolled" to --temperature-controlled--;

Line 57 — Delete the comma after "Values".

Col. 5 Line 8 — Insert the remainder of Table I as follows:

| Circuit Element Designation | Value or Part Number |
|---|---|
| D2 | 1N 4005 |
| D3 | 1N 5231B |
| D5, D6, D7, D8, D9 | 1N 4148 |
| 52 | L111DG |
| K1 | SPST Relay |
| Q1, Q2 | 2N2222 |
| Q3 | 2N5060 |
| Q4 | 2N3906 |
| Q5 | BS170 |
| R1 | 150 ohm |
| R2, R6, R10, R12 | 10K |
| R3 | 33 ohm |
| R4 | 1M |
| R5 | 2.2K |
| R7, R11, R18, R19, R21 | 100K |
| R8 | 120 ohm |
| R9, R13, R22 | 1K |
| R14, R15 | 4.7K |
| R16, R17 | 150K |
| R20 | 500K pot |
| U1 | LM211N |
| U2 | LM556 |

UNITED STATES PATENT AND TRADEMARK OFFICE
CERTIFICATE OF CORRECTION

PATENT NO. : 4,991,532

DATED : February 12, 1991

INVENTOR(S) : Richard A. Locke

It is certified that error appears in the above-identified patent and that said Letters Patent is hereby corrected as shown below:

| | | |
|---|---|---|
| Col. 7, | Line 27 | After "engine" insert a semicolon. |
| Col. 8, | Line 15 | Change "Claim 6" to read --Claim 5--; |
| | Line 18 | Change "Claim 6" to read --Claim 5--. |

Signed and Sealed this

Sixteenth Day of February, 1993

*Attest:*

STEPHEN G. KUNIN

*Attesting Officer*

*Acting Commissioner of Patents and Trademarks*